US008863952B2

(12) United States Patent
Bates et al.

(10) Patent No.: US 8,863,952 B2
(45) Date of Patent: Oct. 21, 2014

(54) PACKAGE, CARTON AND BLANK THEREFOR

(71) Applicant: MeadWestvaco Packaging Systems, LLC, Richmond, VA (US)

(72) Inventors: Aaron L. Bates, Moseley, VA (US); Bradford J. Walling, Chesterfield, VA (US); Kyle Schumaker, Greer, SC (US)

(73) Assignee: MeadWestvaco Packaging Systems, LLC, Richmond, VA (US)

( * ) Notice: Subject to any disclaimer, the term of this patent is extended or adjusted under 35 U.S.C. 154(b) by 13 days.

(21) Appl. No.: 13/622,126

(22) Filed: Sep. 18, 2012

(65) Prior Publication Data

US 2013/0015090 A1 Jan. 17, 2013

Related U.S. Application Data

(63) Continuation-in-part of application No. PCT/US2012/023711, filed on Feb. 3, 2012.

(60) Provisional application No. 61/441,240, filed on Feb. 9, 2011.

(51) Int. Cl.

| | |
|---|---|
| ***B65D 75/00*** | (2006.01) |
| ***B65D 5/42*** | (2006.01) |
| ***B65D 65/12*** | (2006.01) |

(52) U.S. Cl.

CPC .... *B65D 5/4266* (2013.01); *B65D 2571/00728* (2013.01); *B65D 2571/00574* (2013.01); *B65D 2571/0066* (2013.01); *B65D 2571/00141* (2013.01); *B65D 2571/0045* (2013.01); *B65D 2571/00833* (2013.01); *B65D 65/12* (2013.01)

USPC ..... 206/427

(58) Field of Classification Search

USPC ..... 206/427, 430, 433, 434, 147; 229/117.16, 89, 90, 109, 103.2, 103.3

See application file for complete search history.

(56) References Cited

U.S. PATENT DOCUMENTS

| | | | | |
|---|---|---|---|---|
| 5,197,598 | A | 3/1993 | Stout et al. | |
| 5,246,112 | A * | 9/1993 | Stout et al. | 206/427 |
| 5,704,470 | A * | 1/1998 | Sutherland | 206/147 |
| 6,227,367 | B1 * | 5/2001 | Harrelson et al. | 206/427 |
| 7,478,743 | B2 | 1/2009 | Holley, Jr. | |
| 2006/0081691 | A1 * | 4/2006 | Smalley | 229/103.2 |
| 2006/0169755 | A1 * | 8/2006 | Spivey, Sr. | 229/117.16 |
| 2006/0254942 | A1 * | 11/2006 | Cargile, Jr. | 206/427 |
| 2007/0164093 | A1 * | 7/2007 | Spivey et al. | 229/122 |

FOREIGN PATENT DOCUMENTS

| | | | |
|---|---|---|---|
| EP | 0044169 | B1 | 11/1985 |

* cited by examiner

*Primary Examiner* — Jacob K Ackun
*Assistant Examiner* — Jenine Pagan
(74) *Attorney, Agent, or Firm* — MeadWestvaco Intellectual Property Group

(57) ABSTRACT

Each of the first and second side panels of a tubular carton includes a notional longitudinal line disposed at an elevation above the bottom panel that is below the elevation of the shoulders of the bottles. At least one of the opposed ends of the tubular carton is closed by a composite end wall. The composite end wall includes pair of first and second side end closure flaps hingedly connected to the side panels of the carton along first fold lines respectively. Each of the first fold lines is interrupted by a pair of at least substantially triangular panels, each of the pairs of at least substantially triangular panels is formed such that a lowermost triangular panel of the pair is disposed below the respective notional longitudinal line and such that an uppermost triangular panel of the pair is disposed above the respective notional longitudinal line.

16 Claims, 5 Drawing Sheets

PACKAGE, CARTON AND BLANK THEREFOR

RELATED APPLICATIONS

This application is a continuation-in-part of PCT Application Number PCT/US2012/023711, filed Feb. 3, 2012, which claims the benefit of U.S. Provisional Application No. 61/441,240, filed Feb. 9, 2011, each of which are also incorporated herein by reference in their entirety.

FIELD OF THE INVENTION

The present invention relates to a package comprising a carton and a blank for forming the carton, wherein an arrangement is provided to improve the close and/or tight fit of the carton about a group of articles to minimise or eliminate gaps in the corners of the carton to mitigate against article damage due to article collision within the package.

BACKGROUND OF THE INVENTION

In the field of packaging it is often required to provide consumers with a package comprising multiple primary product containers, such multi-packs are desirable for shipping and distribution and for display of promotional information. For cost and environmental considerations, such cartons or carriers need to be formed from as little material as possible and cause as little wastage in the materials from which they are formed as possible.

Another consideration is the closeness of the fit of the carton about the package for securely holding the articles. This is of particular concern where the articles are tapered, round and/or fragile, for example glass bottles. Where round articles are contained in a square-shaped carton, there is space at the corners of the carton. This space allows the round articles some degree of movement within the carton which may cause the articles to damage one another. For example, product labelling may be scuffed, the bottles may be chipped or could even break because of the glass bottles knocking against one another. The closeness of the match between the carton shape and the shape of an article group is therefore an important consideration for both the security of the articles and also for material saving benefits.

In U.S. Pat. No. 5,246,112 to Stout, a carrier is disclosed for packaging bottles which is specifically constructed to prevent bottle breakage due to collision between adjacent bottles. In Stout, a gable topped carrier is provided wherein the top panel of the carrier is not as long or as wide as the bottom panel of the carrier. The side and end walls are tapered and the carrier shape is more closely matched to that of the article group than a square-cornered carton. In addition, it is disclosed in Stout to use pairs of triangular web panels, provided in web panels coupled to the side walls, to form an elongate diamond corner portion. The triangular web panels extend from the vertex of the carrier between the top, side and end walls and terminate between the side and end walls. As such, the corners of the carrier are cut-off proximate to the top, neck and shoulder of the corner bottles. In this way the shape of the carrier is more closely matched to the shape of the bottles and the space between the corner bottles and the corner of the carrier is reduced.

In contrast to the teaching of Stout, in the present invention it has been recognised that a carton or carrier can be constructed with shaped panels that more closely follow the shape of the corner articles and that thereby wrap more tightly, particularly but not exclusively, about the base portions of the articles held within the carrier. By increasing the closeness of the shape of the carton and the tightness with which the carton fits about the articles, the corner gap at least proximate to the base portion of the articles is eliminated or at least minimised and thereby any opportunity for the bottles to move within the package is removed or at least minimised. Furthermore, the automated set-up of a carton according to the present invention may be easier compared to the automated set-up of the carrier disclosed in U.S. Pat. No. 5,246,112.

SUMMARY OF INVENTION

According to a first aspect of the present invention there is provided a package comprising a carton and a group of bottles, the carton comprising a tubular structure formed from an interconnected series of panels including: a top panel, a first side panel, a bottom panel and a second side panel, wherein each of the first and second side panels comprises a notional longitudinal line disposed at an elevation above the bottom panel that is less than the elevation of the shoulders of the bottles, wherein each end of the tubular structure is closed by a composite end wall formed from a series of affixed panels including: a top end closure panel, first and second side end closure panels and a bottom end closure panel, wherein each first and second side end closure panel is hinged to the adjacent first or second side wall along a first fold line, wherein each of the first fold lines is interrupted by a pair of at least substantially triangular panels, each of the pairs of at least substantially triangular panels being formed such that a lowermost triangular panel of the pair is disposed below the notional longitudinal line and such that an uppermost triangular panel of the pair is disposed above said the notional longitudinal line, wherein each of the pairs of at least substantially triangular panels is defined by a pair of divergent fold lines, wherein the lowermost of the triangular panels are each defined by a pair of fold lines diverging from a point spaced above the bottom panel toward the notional longitudinal line and wherein the uppermost of the triangular panels are each defined by a pair of fold lines diverging from a point spaced below the top panel toward the notional longitudinal line, whereby the triangular panels of each pair substantially follow the contour of the corner bottles disposed within the carton at least proximate to the shoulders of the corner bottles such that the bottles are tightly enclosed by the carton.

Preferably, the length of the top panel is at least substantially the same as the length of the bottom panel, and wherein each of the first and second side end closure panels is hinged to the adjacent first or second side wall at about 90°.

Preferably, the point from which the pair of fold lines of the lowermost triangular panels diverge from is spaced above the interconnection between the bottom panel and a first or a second side panel.

Optionally, the point from which the pair of fold lines of the uppermost triangular panels diverge from is spaced below the interconnection between the top panel and a first or a second side panel.

Preferably, wherein the point from which the pair of fold lines of the lowermost triangular panels diverge from is spaced above the bottom panel by a first distance (X), wherein the first distance is between about 5% and 10% of the distance between the bottom panel and the top panel.

Preferably, the first distance is about 7% of the distance between the bottom panel and the top panel.

Optionally, wherein the point from which the pair of fold lines of the uppermost triangular panels diverge from is spaced below the top panel by a second distance (Y), wherein the second distance is between about 30% and 40% of the distance between the bottom panel and the top panel.

Preferably, wherein the second distance is about 33% of the distance between the bottom panel and the top panel.

Optionally, wherein each of the first and second side end closure panels has a height which is less than the distance between the bottom panel and the top panel.

Preferably, wherein each of the first and second side end closure panels terminates in an edge spaced above the bottom panel and wherein the point from which the pair of fold lines of the lowermost triangular panels diverge from is disposed on the edge.

Preferably, the uppermost and lowermost at least substantially triangular panels are each isosceles triangles in shape and wherein the odd angle of each of the uppermost triangular panels is between about 45° and about 55° and/or wherein the odd angle of each of the lowermost triangular panels is between about 25° and about 35°.

Optionally, wherein each fold line of a pair of divergent fold lines that defines one of said uppermost, at least substantially, triangular panels, terminates on the notional longitudinal line at a first and a second point respectively and wherein each fold line of the pair of divergent fold lines that defines the oppositely positioned lowermost, at least substantially, triangular panel, also terminates on the notional longitudinal line and at said first or second point respectively such that together the two pairs of divergent fold lines form a diamond shape.

According to a second aspect of the present invention there is provided a blank for forming a carton for containing bottles, the blank comprising a series of panels for forming an interconnected tubular carton body including: a top panel, a first side panel, a bottom panel and a second side panel, wherein each of the first and second side panels comprises a notional longitudinal line positioned such that when the carton is constructed, the notional longitudinal line is disposed at an elevation above the bottom panel that is less than the elevation of the shoulders of bottles to be or contained in the carton, wherein the blank further comprises a series of panels for forming composite end closure walls including: a top end closure panel, first and second side end closure panels and a bottom end closure panel, wherein each of the first and second side end closure panels is hingedly connected to the adjacent first or second side wall along a first fold line, wherein each of the first fold lines is interrupted by a pair of at least substantially triangular panels, each of the pairs of at least substantially triangular panels being formed such that a lowermost triangular panel of the pair is disposed on one side of the notional longitudinal line and such that an uppermost triangular panel of the pair is disposed on the other side of the notional longitudinal line, wherein each of the pairs of at least substantially triangular panels is defined by a pair of divergent fold lines, wherein the lowermost of the triangular panels are each defined by a pair of fold lines diverging from a point that is spaced from an interconnection between the adjacent first or second side panel and the bottom panel toward the notional longitudinal line and wherein the uppermost of the triangular panels are each defined by a pair of fold lines diverging from a point spaced below an interconnection between the adjacent first or second side panel and the top panel toward the notional longitudinal line, thereby the triangular panels of each pair are configured to substantially follow the contour of the corner bottles, disposed within a carton formed from the blank, at least proximate to the shoulders of the corner bottles such that the bottles can be tightly enclosed by the carton.

Preferably, the length of the top panel is at least substantially the same as the length of the bottom panel and wherein each of the first and second side end closure panels is hingedly connected to the adjacent first or second side wall to be disposed at about 90° with respect thereto when the blank is erected into a carton.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS OF THE PRESENT INVENTION

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

In the embodiments detailed herein, the terms carton and carrier refer, for the non-limiting purpose of illustrating the various features of the invention, to a container for engaging, carrying, and/or dispensing articles, such as bottles. However, it is contemplated that the teachings of the invention can be applied to various containers, which whilst preferably tapered may or may not be cylindrical.

Figure 1:
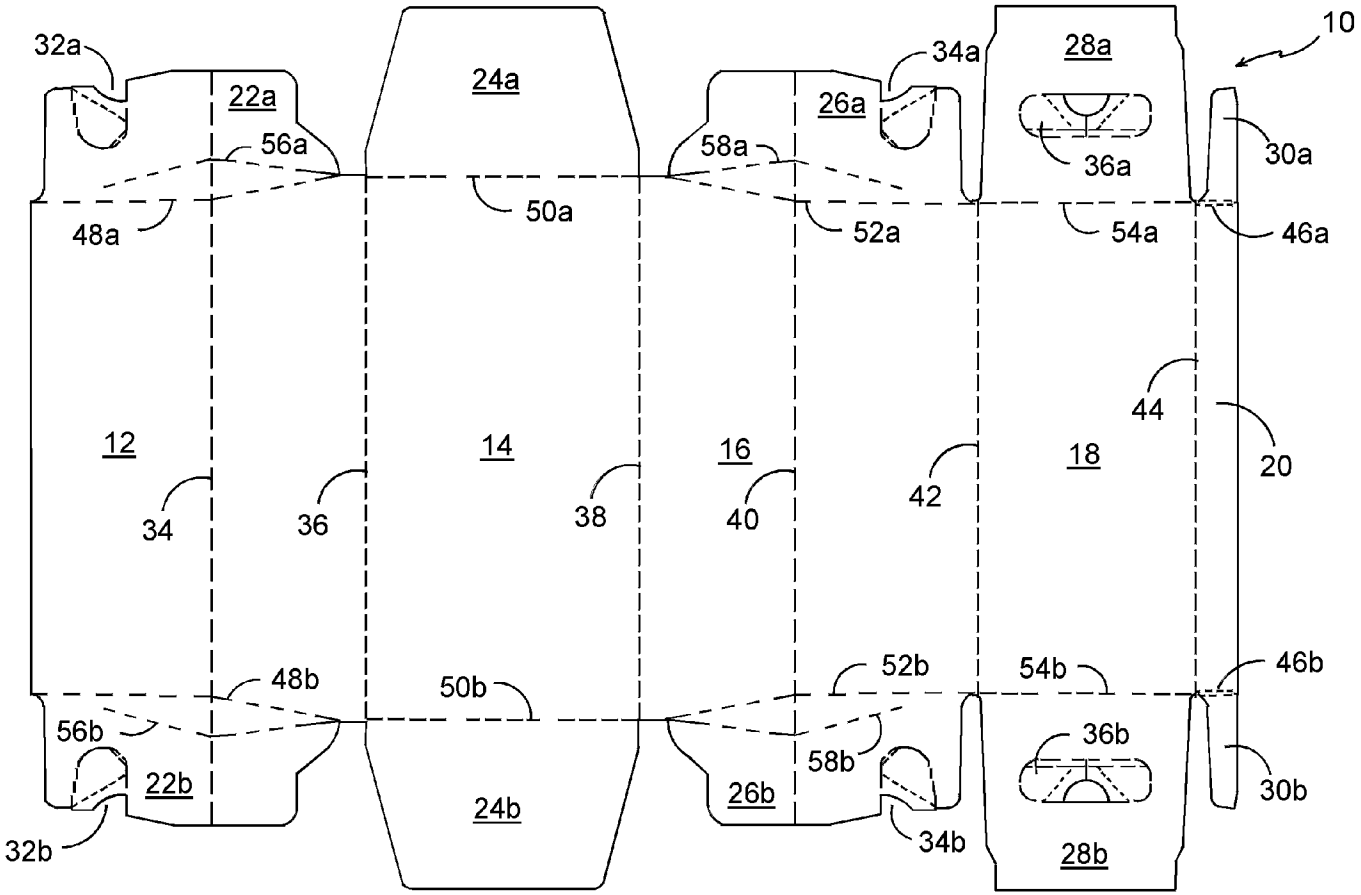
FIG. 1. is a plan view of a sheet of paperboard, cut and scored to form a blank for forming a carton, having a mechanism of reducing the paperboard's resistance to being folded according to an optional aspect of the invention and having an end closure structure according to another aspect of the invention.
Figure 3A:
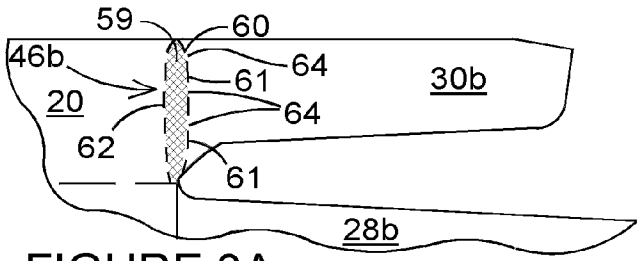
FIG. 3A. is an enlarged view of a section of the blank of FIG. 1 showing a mechanism of reducing the paperboard's resistance to being folded that does not form part of the present invention.
Figure 3B:
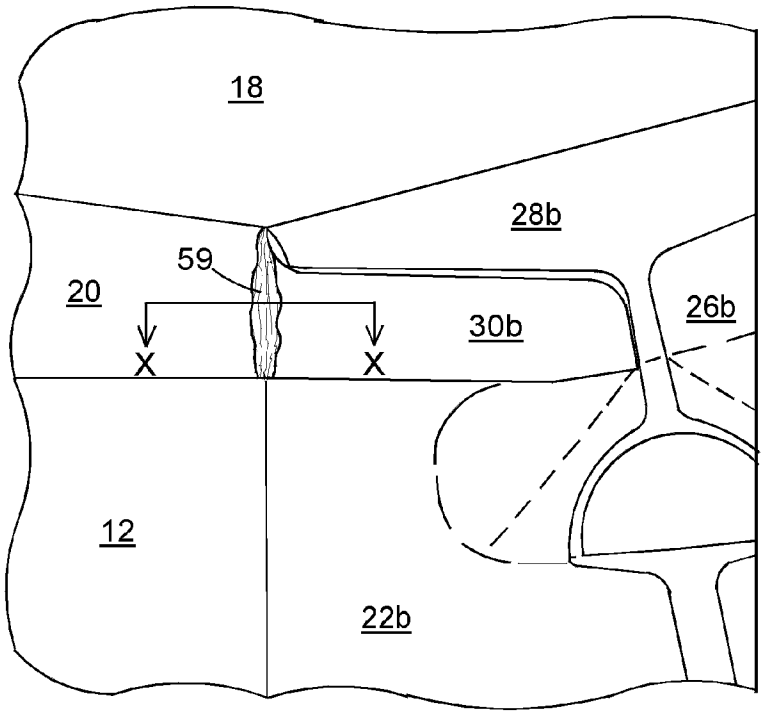
FIG. 3B. is an internal perspective view of a section of the carton of FIG. 2 showing an internal corner where optionally the mechanism shown in FIG. 3A is being used and wherein a side end closure panel is folded.

Referring to FIG. 1 there is shown a plan view of a cut and pre-scored sheet of paperboard material. This is a blank 10 for forming a carton 8 of the end loading type. As such the blank 10 comprises a series of main panels: first side panel 12; bottom panel 14; second side panel 16; top panel 18 and glue flap 20. Each of the main panels is hinged at each of its ends to an end closure flap. The first side panel 12 has side end closure flaps 22*a*, 22*b* hinged thereto along fold lines 48*a*, 48*b*. Bottom panel 14 has bottom end closure flaps 24*a*, 24*b* hinged thereto along fold lines 50*a*, 50*b*. Second side panel 16 has side end closure flaps 26*a*, 26*b* hinged thereto along fold lines 52*a*, 52*b*. Top panel 18 has top end flaps 28*a*, 28*b* hinged thereto along fold lines 54*a*, 54*b* and the glue strip 20 has reinforcing flaps 30*a*, 30*b* hinged thereto by fold resistance reducing mechanisms 46*a*, 46*b*. Additional fold lines 56*a*, 56*b*, 58*a*, 58*b* are provided to define diamond corner portions which assist in the close formation of the carton 8 about the articles.

The main panels are hinged together in series along fold lines 36, 38, 42 and 44. Fold lines 34 and 40 separate the side panels 12 and 16 into two halves which are shaped at their edges such that the resulting carton 8 (see FIG. 2) is a gable topped carton suitable, optionally, for securely packaging 24 beverage bottles. The blank 10 is provided with apertures for forming a handle arrangement. Because the final loaded carton 8 is heavy, the handles formed from the blank 10 need to be strong. The handles are therefore formed from a number of plies of material. The two top end closure flaps 28*a*, 28*b* provide the outermost ply of the handle arrangements in the form of handle components 36*a*, 36*b*. These handle components 36*a*, 36*b* each have a hingeable cushioning flap and a pre-cut handle aperture. The side end closure flaps 26*a*, 26*b*; 22*a*, 22*b* are each provided with further handle components 34*a*, 34*b*, 32*a*, 32*b* that are shaped, sized and oriented to match the handle components 36*a*, 36*b* of the top end flaps 28*a*, 28*b*. The side end closure flaps 26*a*, 26*b*; 22*a*, 22*b* are positionable immediately beneath the top end closure flaps and provide a second ply of the handle structure. To further reinforce the handle structure, handle reinforcing flaps 30*a*, 30*b* are provided. These handle reinforcing flaps 30*a*, 30*b* are sized and positionable adjacent to the handle apertures formed in the top and side end closure flaps and provide a partial third layer or third ply to the handle structure. These handle structures are entirely optional.

Referring more specifically to the diamond corner portions, it can be seen in FIG. 1 that the pairs of fold lines 58*a*, 52*a*; 58*b*, 52*b*; 56*a*, 48*a*; 56*b*, 48*b* define diamond corner portions, which each comprise two triangular panels. In the finished carton 8, one triangular panel of each diamond corner portion is disposed above an optional longitudinal fold line 40, 34 that is disposed coincidentally on a notional longitudinal line of the respective side panel 12 or 16. The notional longitudinal line of each side panel 12 and 16 is disposed at an elevation above the bottom panel 14 below the elevation of the shoulders of the bottles to be packaged in the carton 8. These triangular portions are referred to as upper triangular portions. Similarly, the other triangle of each diamond corner portion is disposed below the respective longitudinal fold line 40, 34. These triangular portions are referred to as lower triangular portions.

Each of the at least substantially triangular panels is defined by a pair of divergent fold lines 58*a*, 52*a*; 58*b*, 52*b*; 56*a*, 48*a*; 56*b*, 48*b*. The lowermost of the triangular panels are each defined by a pair of fold lines that diverge from a point that is spaced from the interconnection 36, 38 between the adjacent first or second side panel 12, 16 and the bottom panel 14 and toward the longitudinal fold line 34, 40 in that adjacent first or second side panel 12, 16. The uppermost of the triangular panels are each defined by a pair of fold lines that diverge from a point spaced below the interconnection 42 between the adjacent first side panel 16 and the top panel 18 (or edge of the second side panel 12) toward the longitudinal fold line 40, 34, in that adjacent first or second side panel 16, 12.

Optionally, the point from which the pair of fold lines of the lowermost triangular panels diverge from is spaced from the interconnection 36, 38 between the adjacent first or second side panel 12, 16 and the bottom panel 14 by a first distance. The first distance is optionally between about 5% and 10% of the height of the first or second side panel 12, 16 (i.e. the distance between the bottom panel 14 and the top panel 18 in a set-up carton 8). Preferably, but nevertheless optionally, the first distance is about 7% of the distance between the bottom panel 14 and the top panel 18 (in a set-up carton 8).

Further optionally, the point from which the pair of fold lines of the uppermost triangular panels diverge from is spaced below the top panel 18 (in a set-up carton 8) by a second distance. Optionally, the second distance is between about 30% and 40% of the height of the first or second side panel 12, 16 (i.e. the distance between the bottom panel 14 and the top panel 18 in a set-up carton 8). Preferably, but nevertheless optionally, the second distance is about 33% of the distance between the bottom panel 14 and the top panel 18.

Figure 2:
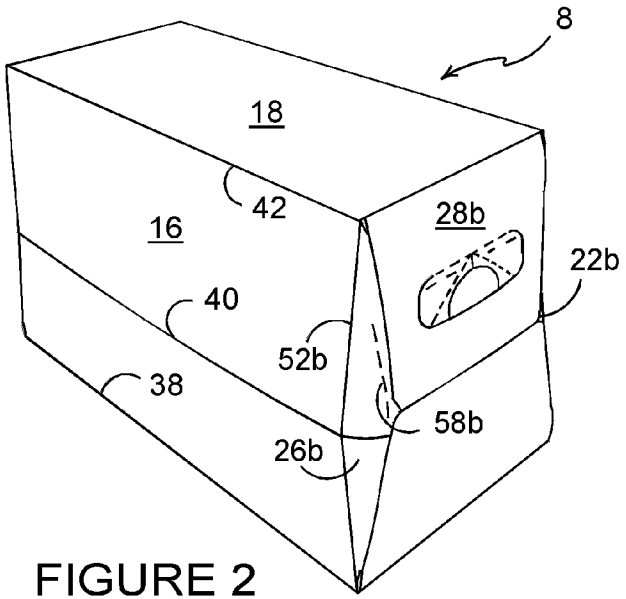
FIG. 2. is a perspective view from the top, side and front end of a carton formed from the blank of FIG. 1.

Turning to the construction of the carton 8 as illustrated in FIG. 2—it is envisaged that the carton 8 can be formed by a series of sequential folding operations in a straight line machine so that the carton 8 is not required to be rotated or inverted to complete its construction. The folding process is not limited to that described below and may be altered according to particular manufacturing requirements.

To form a flat folded part formed carton, glue strip 20, along with top panel 18 and a part of the second side panel 16 is folded about fold line 40 and placed in flat face contact with the second part of the second side panel 16, bottom panel 14 and part of the first side panel 12. Glue is then applied to an outside face of the glue strip 20 and reinforcing flaps 30*a*, 30*b*. The blank 10 is then folded about fold line 34 to bring part of the first side panel 12 and its associated side end flaps 22*a*, 22*b* into overlaying relationship with the glue flap 20, reinforcing flaps 30*a*, 30*b* and part of the first side panel 12 respectively. Pressure is then applied to the first side panel 12 and glue flap 20 and to the side end flaps 22*a*, 22*b* and reinforcing flaps 30*a*, 30*b*. This adheres the inside surface of the first side panel 12 to the outside surface of the glue flap 20 and the outside surface of the reinforcing flaps 30*a*, 30*b* to the inside surfaces of the side end closure flaps 22*a*, 22*b*. Thereby the first side panel 12 is connected to the top panel 18 and in this way a flat-folded tubular structure is formed. In this condition, the blank 10 may be supplied to a converting plant, whereat, the part formed, flat folded blank is opened into an open ended tubular structure, loaded from one or both of its open ends with articles such as bottles and then sealed to form a closed carton or package 8 as shown in FIG. 2.

Each end of the carton 8 is the same and therefore the folding of only one end wall is described. Each side end closure panel 22*b*, 26*b*, is folded about its fold line 48*b*, 52*b*, such that it partially closes the end of the carton 8. In doing this, the reinforcing flap 30*b* that is adhered to side end closure flap 22*b* is also folded. The substantially diamond corner portions assist in the close or tight folding of the end closure panels 22*b*, 26*b* about the end most corner bottles contained in the carton 8.

Optionally, though preferably, the longitudinal length of the top panel 18 (between fold lines 54*a* and 54*bb*) is less than the longitudinal length of the bottom panel 14 (between fold lines 50*a* and 50*b*). As such the fold lines 50*a*, 52*a*, 54*a* and 48*a* are not in linear alignment line with one another when the blank 10 is disposed in flat form (as in FIG. 1). Similarly, the fold lines 50*b*, 52*b*, 54*b* and 48*b* are not in line with one another when the blank 10 is disposed in flat form (as in FIG. 1). When the blank 10 is constructed into a carton 8, the top end closure panels 28*a*, 28*b*, first and second side end closure panels 26*a*, 26*b*, 22*a*, 22*b* and bottom end closure panels 24*a*, 24*b* are each folded at an angle that is not necessarily about 90°, about the respective fold line 54*a*, 54*b*, 52*a*, 52*b*, 50*a*, 50*b*, 48*a*, 48*b*. This may be referred to as a "tapered-ended" carton 190.

The triangular panels of each pair 159*b* form a diamond corner portion 48*a*/56*a*, 52*a*/58*a*, 48*b*/56*b*, 52*b*/58*b* that bends about and substantially follows the contour of the corner bottles 'B' that are disposed close to the diamond corner portion 48*a*/56*a*, 52*a*/58*a*, 48*b*/56*b*, 52*b*/58*b* of the loaded carton 8.

Preferably, but nevertheless optionally, the uppermost triangular panels are sized to fit about the top of a shoulder of a bottle 'B' and may optionally be shorter than the lowermost triangular panels. In this way, the diamond corner portions 48*a*/56*a*, 52*a*/58*a*, 48*b*/56*b*, 52*b*/58*b*, not only cut-off or cut across the diagonal of the square corner that would otherwise be created by the composite end walls formed from the end closure panels (top end closure panels 28*a*, 28*b*, first and second side end closure panels 26*a*, 26*b*, 22*a*, 22*b* and bottom end closure panels 24*a*, 24*b*), but fold and even curve slightly about the bottles 'B', at least proximate to the shoulders of the corner bottles 'B' and therebelow such that the bottles 'B' are wrapped by the carton 8 and can be tightly enclosed by the carton 8 to mitigate against chinking of the bottles 'B'.

Construction of the carton 8 is completed by optionally folding the top end closure panels 24*a*, 24*b* into face contacting, overlapping and affixed relationship with the upper portions of the side end closure panels 26*a*, 26*b*, 22*a*, 22*b*. Finally the bottom end closure panels 24*a*, 24*b* are folded upwardly and into face contacting, overlapping and affixed relationship with the lower portions of the side end closure panels 26*a*, 26*b*, 22*a*, 22*b*.

The handle arrangement 36*a*, 36*b*, 34*a*, 34*b*, 32*a*, 32*b* is entirely optional and is not described further.

Figure 4:
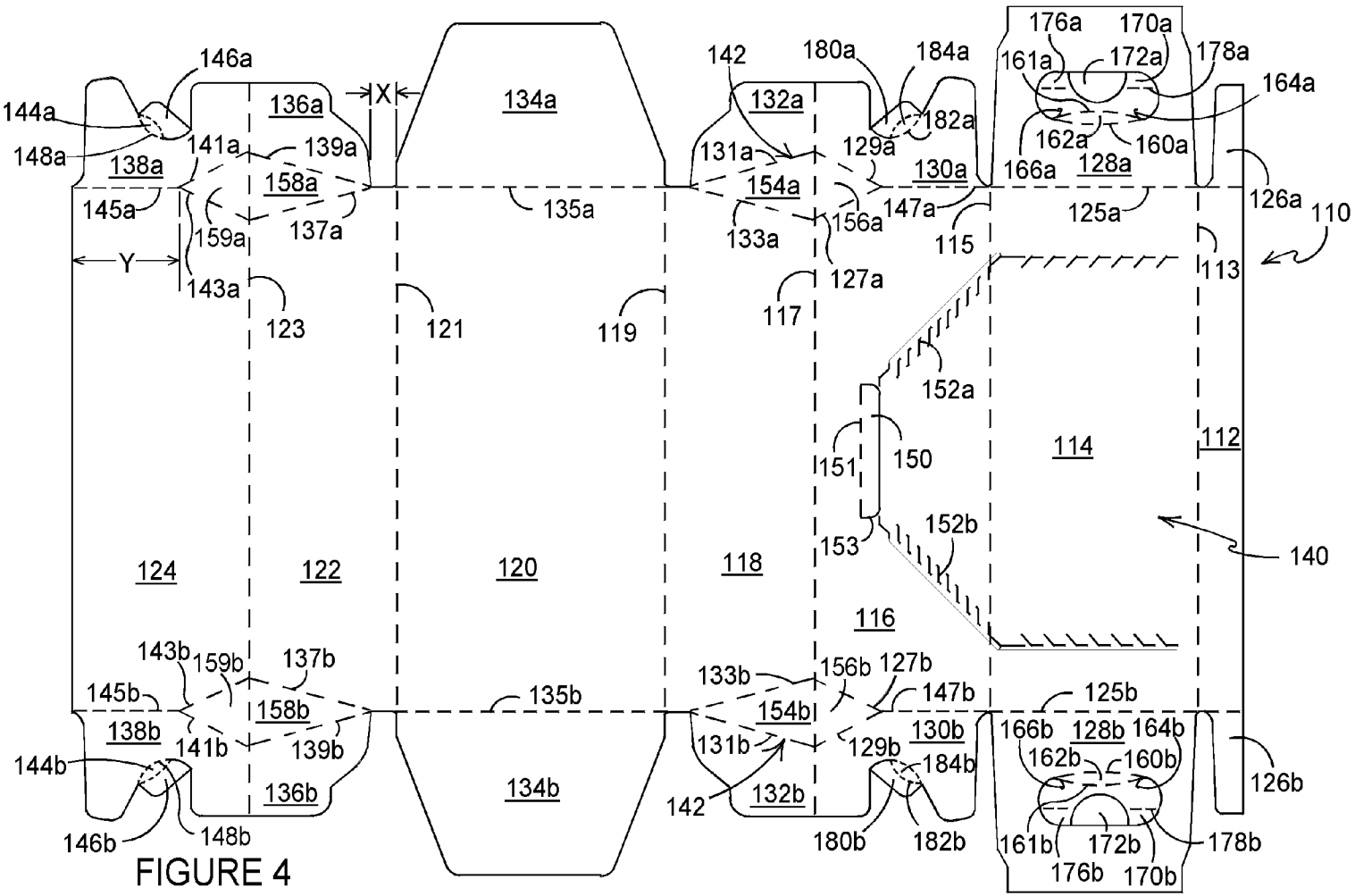
FIG. 4. is a plan view of a blank for forming a carton according to another embodiment of the invention.
Figure 6:
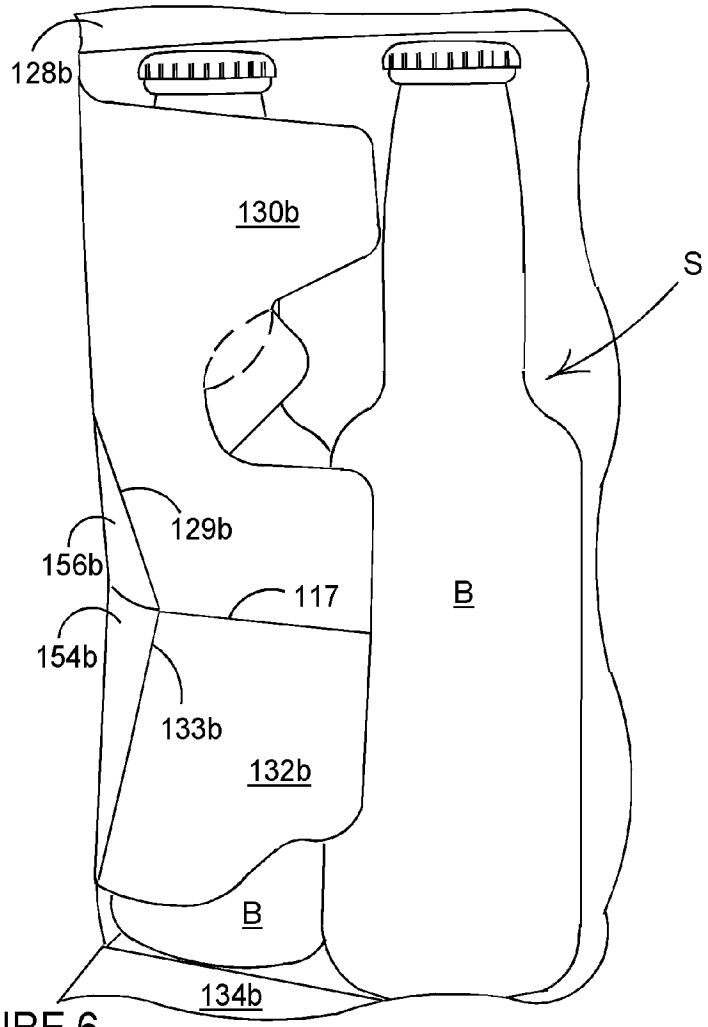
FIG. 6. is a perspective partial view from the side and end of a carton constructed from the blank of FIG. 4 in a loaded and partially completed condition.

In FIG. 4, there is shown another blank 110 for forming a carton 190 according to another embodiment of the invention. In the drawings provided in FIGS. 4 to 8, the reference numerals used are different to and do not necessarily correlate with those of the first illustrated embodiment of FIGS. 1 to 3B.

The blank 110 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, for example, to provide the carrier structure described in more detail below.

In the exemplary embodiment, the blank 110 is configured to form a carton or carrier for packaging an exemplary arrangement of exemplary articles 'B'. For example, the arrangement is a matrix including rows and columns such as a 3×6 arrangement of bottles 'B'. The blank 110 can be alternatively configured to form a carrier 90 for packaging other articles 'B' and/or different arrangements of articles 'B'.

The blank 110 is optionally, but nevertheless preferably configured for forming a carton 190 for containing bottles 'B'. The blank 110 comprises a series of panels for forming an interconnected tubular carton body including: a top panel 114, a first side panel 116/118, a bottom panel 120 and a second side panel 122/124. The series of panels are hinged together along longitudinal fold lines 115, 119 and 121. A glue panel or lap panel 112 is disposed at one end of the blank 110 for affixing the opposite ends of the blank 110 together. The glue panel 112 is optionally hinged to the top panel 114 by means of a fold line 113. Glue panel flaps 126*a*, 126*b* are optionally hinged to each end thereof.

The blank 110 further comprises a series of panels at each end of the blank 110 for forming composite end closure walls including: top end closure panels 128*a*, 128*b*, first and second side end closure panels 130*a*/132*a*, 130*b*/132*b*, 136*a*/138*a*, 136*b*/138*b* and bottom end closure panels 134*a*, 134*b*. The top end closure panels 128*a*, 128*b* are hinged to each end of the top panel 114 by means of fold lines 125*a*, 125*b* respectively. The first side end closure panels 130*a*/132*a*, 130*b*/132*b* are hinged to each end of the first side panel 116/118 by means of fold lines 147*a*, 147*b*. These fold lines 147*a*, 147*b* are also referred to herein as first fold lines 147*a*, 147*b*. The second side end closure panels 136*a*/138*a*, 136*b*/138*b* are hinged to each end of the second side panel 122/124 along fold lines 145*a*, 145*b*. The fold lines 145*a*, 145*b* are also referred to herein as first fold lines 145*a*, 145*b*. The bottom end closure panels 134*a*, 134*b* are hinged to each end of the bottom panel 120 along fold lines 135*a*, 135*b*.

Optionally, though preferably, the longitudinal length of the top panel 114 (between fold lines 125*a* and 125*b*) is at least substantially the same as the longitudinal length of the bottom panel 120 (between fold lines 135*a* and 135*b*). The term "at least substantially the same" should be interpreted as meaning either approximately the same or exactly the same. As such the fold lines 125*a*, 147*a*, 135*a* and 145*a* are in line with one another when the blank 110 is disposed in flat form (as in FIG. 4). Similarly, the fold lines 125*b*, 147*b*, 135*b* and 145*b* are in line with one another when the blank 10 is disposed in flat form (as in FIG. 4). When the blank 10 is constructed into a carton 90, the top end closure panels 128*a*, 128*b*, first and second side end closure panels 130*a*/132*a*, 130*b*/132*b*, 136*a*/138*a*, 136*b*/138*b* and bottom end closure panels 134*a*, 134*b* are each folded at least substantially about 90° about the respective fold line 125*a*, 125*b*, 147*a*, 147*b*, 145*a*, 145*b*, 135*a*, 135*b*. This may be referred to as a "square-ended" carton 190 rather than a tapered ended carton as shown for example in U.S. Pat. No. 5,246,112 to Stout.

Each of the first and second side panels 116/118, 122/124 and first and second side end closure panels 130*a*/132*a*, 130*b*/132*b*, 136*a*/138*a*, 136*b*/138*b* optionally comprises a longitudinally extending fold line 117, 123 that extends coincidentally with a notional longitudinal line for that side panel 116/118 or 122/124. The notional longitudinal line for each side panel 116/118 and 112/124 is disposed at an elevation above the bottom panel 120 that is below the elevation of the shoulders of the bottles to be packaged in the carton to be erected from the blank 110 of FIG. 4. The longitudinally extending fold line 117 separates the first side panel 116/118 into an upper first side panel 116 and a lower first side panel 118. Similarly, the longitudinally extending fold line 123 separates the second side panel 122/124 into an upper second side panel 124 and a lower second side panel 122. Additionally, the longitudinally extending fold line 117 separates the first side end closure panels 130*a*/132*a*, 130*b*/132*b* into upper 130*a*, 130*b* and lower 132*a*, 132*b* first side end closure panels. Additionally, the longitudinally extending fold line 123 separates the second side end closure panels 136*a*/138*a*, 136*b*/138*b* into upper 138*a*, 138*b* and lower 136*a*, 136*b* second side end closure panels.

Optionally, each longitudinally extending fold line 117, 123 is positioned such that when the carton 190 is constructed (see FIG. 8), the longitudinal fold line 117, 123 is disposed at an elevation above the bottom panel 120 that is less than the elevation of the shoulders of bottles 'B' that are contained in the carton 190.

Each of the first fold lines 147*a*, 147*b*, 145*a*, 145*b* is interrupted by a pair of at least substantially triangular panels 156*a*/154*a*, 156*b*/154*b*, 158*a*/159*a*, 158*b*/159*b*. The term "at least substantially triangular panel" should be interpreted as meaning either a panel with a shape approximating a triangular shape or a panel having a perfectly triangular shape. Each of the pairs of at least substantially triangular panels 156*a*/154*a*, 156*b*/154*b*, 158*a*/159*a*, 158*b*/159*b* is optionally formed such that a lowermost triangular panel 154*a*, 154*b*, 158*a*, 158*b* of the pair 156*a*/154*a*, 156*b*/154*b*, 158*a*/159*a*, 158*b*/159*b* is disposed on one side of the longitudinal fold line 117, 123 adjacent the lower first or second side panel 118, 122 and such that an uppermost triangular panel 156*a*, 156*b*, 159*a*, 159*b* of the pair 156*a*/154*a*, 156*b*/154*b*, 158*a*/159*a*, 158*b*/159*b* is disposed on the other side of the longitudinal fold line 117, 123, adjacent the first or second upper side panel 116, 124.

Each of the at least substantially triangular panels 156*a*, 154*a*, 156*b*, 154*b*, 158*a*, 159*a*, 158*b*, 159*b* is defined by a pair of divergent fold lines 127*a*, 129*a*; 131*a*, 133*a*; 127*b*, 129*b*; 133*b*, 131*b*; 139*a*, 137*a*; 141*a*, 143*a*; 137*b*, 139*b*; 143*b*, 141*b*. The lowermost of the triangular panels 154*a*, 154*b*, 158*a*, 158*b* are each defined by a pair of fold lines 131*a*, 133*a*; 133*b*, 131*b*; 141*a*, 143*a*; 143*b*, 141*b* diverging from a point that is spaced from the interconnection 119, 121 between the adjacent first or second side panel 118/116, 122/124 and the bottom panel 120 and toward the longitudinal fold line 117, 123 in that adjacent first or second side panel 118/116, 122/124. The uppermost of the triangular panels 156*a*, 156*b*, 159*a*, 159*b* are each defined by a pair of fold lines 127*a*, 129*a*; 127*b*, 129*b*; 139*a*, 137*a*; 137*b*, 139*b*; that diverge from a point spaced below the interconnection 115 between the adjacent first side panel 116/118 and the top panel 120 (or edge of the second side panel 122/124) toward the longitudinal fold line 117, 123, in that adjacent first or second side panel 118/116, 122/124.

Optionally, the point from which the pair of fold lines 131*a*, 133*a*; 133*b*, 131*b*; 141*a*, 143*a*; 143*b*, 141*b* of the lowermost triangular panels 154*a*, 154*b*, 158*a*, 158*b* diverge from is spaced from the interconnection 119, 121 between the adjacent first or second side panel 116/118, 122/124 and the bottom panel 120 by a first distance 'X. The first distance 'X' is optionally between about 5% and 10% of the height of the first or second side panel 116/118, 122/124 (i.e. the distance between the bottom panel 120 and the top panel 114 in a set-up carton 190). Preferably, but nevertheless optionally, the first distance is about 7% of the distance between the bottom panel 120 and the top panel 114 (in a set-up carton 190).

Further optionally, the point from which the pair of fold lines 127*a*, 129*a*; 127*b*, 129*b*; 139*a*, 137*a*; 137*b*, 139*b* of the uppermost triangular panels 156*a*, 156*b*, 159*a*, 159*b* diverge from is spaced below the top panel 114 (in a set-up carton 190) by a second distance 'Y'. Optionally, the second distance 'Y' is between about 30% and 40% of the height of the first or second side panel 116/118, 122/124 (i.e. the distance between the bottom panel 120 and the top panel 114 in a set-up carton 190). Preferably, but nevertheless optionally, the second distance 'Y' is about 33% of the distance between the bottom panel 120 and the top panel 114.

The blank 110 comprises additional optional features that do not necessarily form part of the focus of the invention. For example an entirely optional carrying handle arrangement and an entirely optional access feature. These optional features will now be very briefly described and it will be understood that these features may be excluded and/or substituted for alternative carrying handle arrangements and/or access features in other embodiments of the invention.

The carrying handle arrangement comprises two outer handle arrangements 160*a*, 161*a*, 162*a*, 166*a*, 164*a*, 172*a*, 170*a*, 176*a*, 178*a*; 160*b*, 161*b*, 162*b*, 166*b*, 164*b*, 172*b*, 170*b*, 176*b*, 178*b* formed in the top end closure panels 128*a*, 128*b* respectively. The outer handle arrangements are supported by inner handle flaps 180*a*, 180*b*, 146*a*, 146*b* formed in the side end closure panels 130*a*/132*a*, 130*b*/132*b*, 136*a*/138*a*, 136*b*/138*b*. An outer handle flap is hinged to the top end closure panel 128*a*, 128*b* by means of opposed arcuate fold lines 160*a*/161*a*; 160*b*/161*b* and a leaf-shaped panel 162*a*; 162*b*. Inward movement of the handle panel creates a handle aperture though which a user can at least partially insert at least part of their hand for grasping the carton 90 about a cushioned upper edge, which cushioned upper edge is supported and/or further cushioned by the arcuate fold lines 148*a*, 182*a*, 182*b*, 148*b* and leaf-shaped panels 184*a*, 184*b*, 144*a*, 144*b* of the inner handle flaps 180*a*, 180*b*, 146*a*, 146*b*.

The access feature 140 comprises a detachable section defined by a perforate or weakened line 152*a*, 152*b*, 151 and having an initiator section 150 that is defined by a cut line 153 and hinge line 151.

Turning to the construction of the carton 190 from the blank 110 it is envisaged that the carton 190 can be formed by a series of sequential folding operations in a straight line machine so that the carton 190 is not required to be rotated or inverted to complete its construction. The folding process is not limited to that described below and may be altered according to particular manufacturing requirements.

The blank 110 is optionally folded about longitudinal fold line 117 to bring the upper first side panel 116, top panel 114 and glue panel 112 (with their associated end closure panels 130*a*, 130*b*, 128*a*, 128*b*, 126*a*, 126*b*) into face contacting relationship with the inside face of lower first side panel 118 and bottom panel 120 respectively. Adhesive, for example hot-melt glue, may be applied to the glue panel 112 (and the flaps 126*a*, 126*b*). In other envisaged embodiments other affixing means may be used, for example, tape, pressure-adhesive, staples, clips or mechanical locking features. The upper second side panel 124 (with its associated end closure panels 138*a*, 138*b*) is then folded about longitudinal fold line 123 to bring it into partial overlapping face contacting relationship with an inside face of the lower second side panel 122 and into overlapping face contacting relationship with an outside face of the glue panel 112 such that the upper second side panel 124 is interconnected to the top panel 114. The resulting work product is a part formed—flat folded blank.

Figure 5:
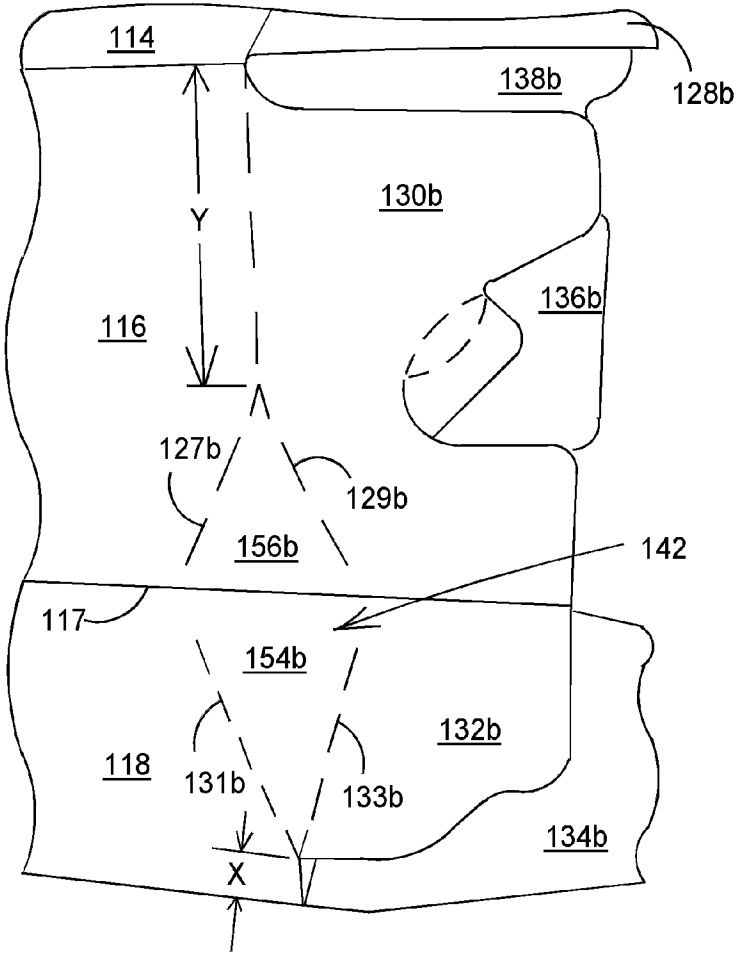
FIG. 5. is a perspective partial view from the side and end of a carton constructed from the blank of FIG. 4 in an open and un-loaded condition.
Figure 8:
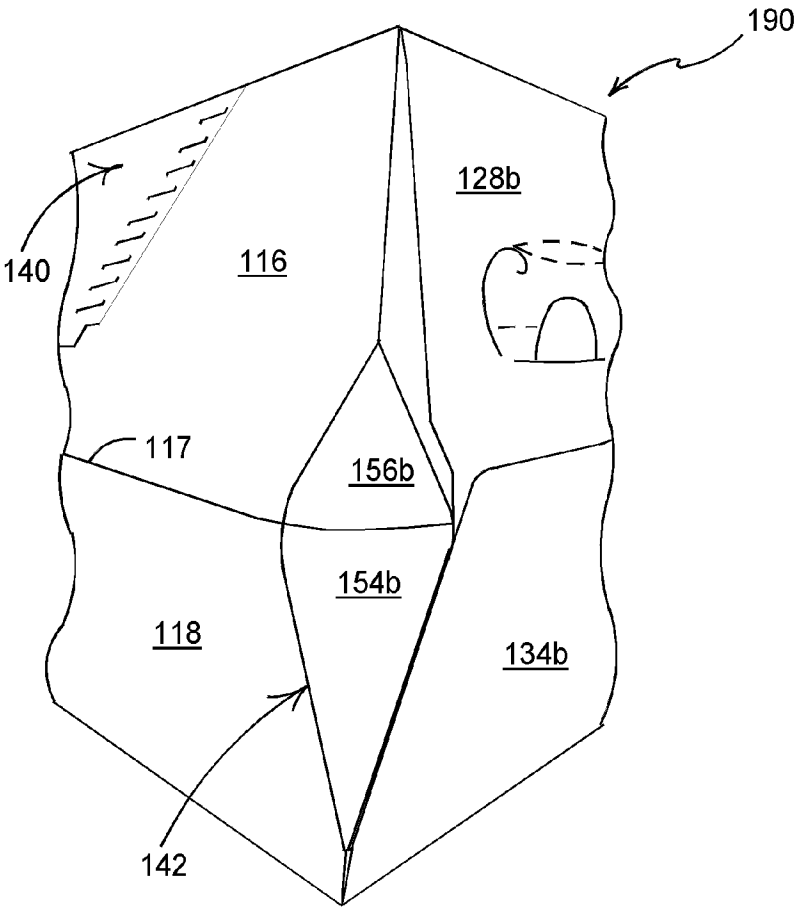
FIG. 8. is a perspective partial view from the side and end of a package comprising a carton formed from the blank of FIG. 4, loaded with a group of bottles and closed by construction of composite end walls.

The part formed—flat folded blank is then opened into a tubular structure, FIG. 5 shows a partial perspective view of the open ended carton 190. It can be seen herein that the first end closure panel 130*b*/132*b* does not extend down to the plane of the bottom panel 120. In other embodiments, the first end closure panel 130*b*/132*b* (and similarly the other side end closure panels 130*a*/132*a*; 136*a*/138*a*, 136*b*/138*b*) may extend at least in part down to the plane of the bottom panel 120, but the lowermost triangular panel 154*b* (154*a*, 159*a*, 159*b*) will be spaced above the plane of the bottom panel 120. Preferably, however the first end closure panel 130*b*/132*b* (and similarly the other side end closure panels 130*a*/132*a*; 136*a*/138*a*, 136*b*/138*b* do not extend down to the plane of the bottom panel 120 and this may provide clearance room for a static guide or other guiding member of a packaging machine which is used optionally to hold the bottom end closure panel 134*b*, 134*a* either in the position shown in FIG. 5 or folded downwardly.

The carton 190 is then loaded with articles, preferably bottles 'B', though one or both ends thereof. The composite end walls are then formed. Optionally, the first and second side end closure panels 130*a*/132*a*, 130*b*/132*b*, 136*a*/138*a*, 136*b*/138*b* are folded about the first fold lines 147*a*, 147*b*, 145*a*, 145*b*. See FIG. 5 which shows the first side end closure panel 130*b*/132*b* having been folded. Preferably the first fold line 147*a*, 147*b*, 145*a*, 145*b* defines a corner between the first and second side panel 116/118, 122/124 and the first and second side end closure panels 130*a*/132*a*, 130*b*/132*b*, 136*a*/138*a*, 136*b*/138*b* that is at least substantially a 90° corner. In this way the triangular panels 156*a*/154*a*, 156*b*/154*b*, 158*a*/159*a*, 158*b*/159*b* of each pair 156*a*/154*a*, 156*b*/154*b*, 158*a*/159*a*, 158*b*/159*b* form a diamond corner portion 142 that bends about and substantially follows the contour of the corner bottles 'B' that are disposed close to the diamond corner portion 142 of the loaded carton 190.

Preferably, but nevertheless optionally, the uppermost triangular panels 156*a*, 156*b*, 159*a*, 159*b* are sized to fit about the top of a shoulder 'S' of a bottle 'B' and may optionally be shorter than the lowermost triangular panels 154*a*, 154*b*, 158*a*, 158*b*. In this way, the diamond structures 142, not only cut-off or cut across the diagonal of the square corner that would otherwise be created by the composite end walls formed from the end closure panels (top end closure panels 128*a*, 128*b*, first and second side end closure panels 130*a*/132*a*, 130*b*/132*b*, 136*a*/138*a*, 136*b*/138*b* and bottom end closure panels 134*a*, 134*b*), but fold and even curve slightly about the bottles 'B', at least proximate to the shoulders 'S' of the corner bottles 'B' and therebelow such that the bottles 'B' are wrapped by the carton 190 and can be tightly enclosed by the carton 190 to mitigate against chinking of the bottles 'B'. See FIG. 6 which illustrates the close fit and tight wrapping of the shaped end closure panel 130*b*/132*b* and diamond corner portion 142 about the corner article 'B'.

Figure 7:
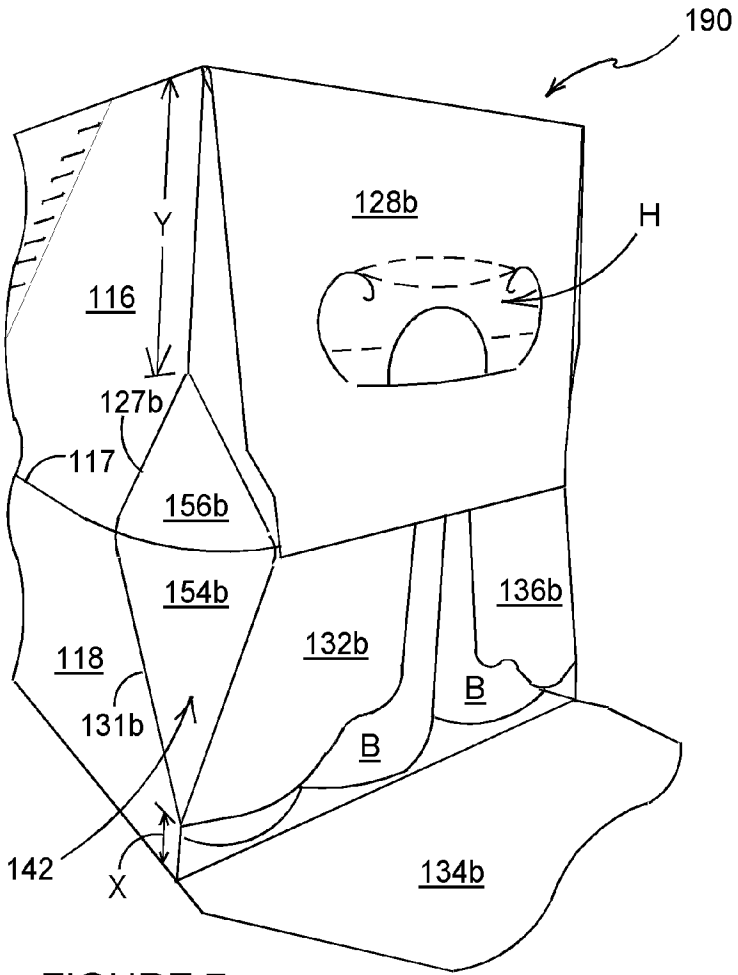
FIG. 7. is a perspective partial view from the side and end of the carton of FIG. 6, wherein a top end closure panel has been placed into a closed condition, but the end wall still not fully constructed.

Construction of the carton 190 is completed by optionally folding the top end closure panels 128*a*, 128*b* into face contacting, overlapping and affixed relationship with the upper portions 130*b*, 130*a*, 138*a*, 138*b* of the side end closure panels 130*a*/132*a*, 130*b*/132*b*, 136*a*/138*a*, 136*b*/138*b* (see FIG. 7). Finally the bottom end closure panels 134*a*, 134*b* are folded upwardly and into face contacting, overlapping and affixed relationship with the lower portions 132*b*, 132*a*, 136*a*, 136*b* of the side end closure panels 130*a*/132*a*, 130*b*/132*b*, 136*a*/138*a*, 136*b*/138*b* (see FIG. 8).

It can be appreciated that various changes may be made within the scope of the present invention, for example, the size and shape and relative position of the triangular panels may be adjusted to accommodate articles of differing size or shape. Optionally, the uppermost and lowermost at least substantially triangular panels 156*a*/154*a*, 156*b*/154*b*, 158*a*/159*a*,158*b*/159*b* are each isosceles triangles in shape. The odd angle of each of the uppermost triangular panels may be between about 25° and 35° and/or the odd angle of each of the lowermost triangular panels may be between about 45° and 55°. In other embodiments the triangular panels are the same size and/or the same shape. In other embodiments the triangular panels are equally spaced from the top and bottom panels. In other embodiments the lowermost triangular panels is relatively disposed further up the carton. In other embodiments the second distance 'Y' is less than or equal to the first distance 'X'

It will be recognised that as used herein, directional references such as "top", "bottom", "front", "back", "end", "side", "inner", "outer", "upper" and "lower" do not limit the respective panels to such orientation, but merely serve to distinguish these panels from one another.

As used herein, the terms "hinged connection" and "fold line" refers to all manner of lines that define hinge features of the blank, facilitate folding portions of the blank with respect to one another, or otherwise indicate optimal panel folding locations for the blank. A fold line is typically a scored line, an embossed line, or a debossed line. Any reference to hinged connection or fold line should not be construed as necessarily referring to a single fold line only; indeed it is envisaged that hinged connection can be formed from any one or more of the following, a short slit, a frangible line or a fold line without departing from the scope of the invention.

As used herein, the term "severance line" refers to all manner of lines that facilitate separating portions of the substrate from one another or that indicate optimal separation locations. Severance lines may be frangible or otherwise weakened lines, tear lines, cut lines, or slits.

It should be understood that hinged connection, severance lines and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The invention claimed is:

1. A package comprising a carton and a group of bottles, the carton comprising a tubular structure formed from an interconnected series of panels including: a top panel, a first side panel, a bottom panel and a second side panel, the top panel being disposed over tops of the bottles, each of the first and second side panels comprising a notional longitudinal line disposed at an elevation above the bottom panel that is below the elevation of shoulders of the bottles, wherein at least one of opposed ends of the tubular structure is closed by a composite end wall formed from a series of affixed panels including: a top end closure panel, first and second side end closure panels and a bottom end closure panel, wherein each first and second side end closure panel is hinged to the adjacent first or second side wall along a first fold line, wherein each of the first fold lines is interrupted by a pair of at least substantially triangular panels, each of the pairs of the at least substantially triangular panels being formed such that a lowermost triangular panel of the pair is disposed between the respective notional longitudinal line and the bottom panel and such that an uppermost triangular panel of the pair is disposed between the respective notional longitudinal line and the top panel, wherein the lowermost triangular panel of the pair is defined by a pair of fold lines diverging from a lower point spaced below the respective notional longitudinal line toward the respective notional longitudinal line, and wherein the uppermost triangular panel of the pair is defined by a pair of fold lines diverging from an upper point spaced above the respective notional longitudinal line toward the respective notional longitudinal line, whereby the triangular panels of each pair substantially follow the respective contour of the corner bottle disposed within the carton at least proximate to a shoulder of the respective corner bottle such that the bottles are tightly enclosed by the carton, and wherein a distance from the lower point to the respective notional longitudinal line is greater than a distance from the upper point to the respective notional longitudinal line, such that the lower most triangular panel is taller than the uppermost triangular panel.

2. The package according to claim 1, wherein the length of the top panel is at least substantially the same as the length of the bottom panel, and wherein each of the first and second side end closure panels is hinged to the adjacent first or second side wall and disposed at about 90 degrees with respect to the adjacent first or second side wall.

3. The package according to claim 1, wherein the upper point from which the pair of fold lines of the uppermost triangular panels diverge from is spaced below an interconnection between the top panel and the first or the second side panel.

4. The package according to claim 3, wherein the lower point from which the pair of fold lines of the lowermost triangular panels diverge from is spaced above an interconnection between the bottom panel and the first or the second side panel.

5. The package according to claim 4, wherein the lower point from which the pair of fold lines of the lowermost triangular panels diverge from is spaced above the bottom panel by a first distance (X), wherein the first distance is between about 5% and 10% of a distance between the bottom panel and the top panel.

6. The package according to claim 5, wherein the first distance is about 7% of the distance between the bottom panel and the top panel.

7. The package according to claim 1, wherein the upper point from which the pair of fold lines of the uppermost triangular panels diverge from is spaced below the top panel by a second distance (Y), wherein the second distance is between about 30% and 40% of a distance between the bottom panel and the top panel.

8. The package according to claim 7, wherein the second distance is about 33% of the distance between the bottom panel and the top panel.

9. The package according to claim 1, wherein each of the first and second side end closure panels has a height which is less than a distance between the bottom panel and the top panel.

10. The package according to claim 9, wherein each of the first and second side end closure panels terminates in an edge spaced above the bottom panel and wherein the lower point from which the pair of fold lines of the lowermost triangular panels diverge from is disposed on the edge.

11. The package according to claim 1, wherein the uppermost and lowermost at least substantially triangular panels are each isosceles triangles in shape and wherein the odd angle of each of the uppermost triangular panels is between about 45° and about 55° and/or wherein the odd angle of each of the lowermost triangular panels is between about 25° and about 35°.

12. The package according to claim 1, wherein the pair of divergent fold lines that define the uppermost triangular panel of the pair terminate on the respective notional longitudinal line at first and second points, respectively, and wherein the pair of divergent fold lines that define the lowermost triangular panel of the pair terminate on the respective notional longitudinal line at said first and second points, respectively, such that the two pairs of the divergent fold lines form a diamond shape.

13. The package according to claim 1, wherein the lowermost triangular panel of the pair comprises a single substantially triangular panel disposed below the respective notional longitudinal line, and wherein the uppermost triangular panel of the pair comprises a single substantially triangular panel disposed above the respective notional longitudinal line.

14. The package according to claim 1, wherein a distance from the lower point to the bottom panel is less than a distance from the upper point to the top panel of the tubular structure.

15. A blank for forming a carton for containing bottles, the blank comprising a series of panels for forming an interconnected tubular carton body including: a top panel disposed over tops of the bottles to be contained in the carton when the carton is constructed, a first side panel, a bottom panel and a second side panel, each of the first and second side panels comprising a notional longitudinal line positioned such that when the carton is constructed, the notional longitudinal line is disposed at an elevation above the bottom panel that is below an elevation of shoulders of the bottles to be contained in the carton, wherein the blank further comprises a series of panels for forming at least one composite end closure wall, the series of panels including: a top end closure panel, first and second side end closure panels and a bottom end closure panel, wherein each of the first and second side end closure panels is hingedly connected to the adjacent first or second side wall along a first fold line, wherein each of the first fold lines is interrupted by a pair of at least substantially triangular panels, each of the pairs of the at least substantially triangular panels being formed such that a lowermost triangular panel of the pair is disposed on one side of the respective notional longitudinal line and such that an uppermost triangular panel of the pair is disposed on the other side of the respective notional longitudinal line, the one side of the respective notional longitudinal line being closer to the bottom panel than the other side of the respective notional longitudinal line when the carton is constructed, wherein the lowermost triangular panel of the pair is defined by a pair of fold lines diverging from a lower point that is spaced from the respective notional longitudinal line toward the respective notional longitudinal line, and wherein the uppermost triangular panel of the pair is defined by a pair of fold lines diverging from an upper point spaced from the respective longitudinal line toward the respective notional longitudinal line, whereby the substantially triangular panels of each pair are configured to substantially follow the contour of the respective corner bottle, disposed within the carton formed from the blank, at least proximate to a shoulder of the respective corner bottle such that the bottles can be tightly enclosed by the carton, wherein a distance from the lower point to the respective notional longitudinal line is greater than a distance from the upper point to the respective notional longitudinal line, such that the lowermost triangular panel is taller than the uppermost triangular panel when the carton is constructed.

16. The blank according to claim 15, wherein a length of the top panel is substantially the same as a length of the bottom panel and wherein each of the first and second side end closure panels is hinged to the adjacent first or second side wall to be disposed at about 90° with respect thereto when the blank is erected into a carton.

* * * * *